US005161269A

United States Patent [19]

McLean et al.

[11] Patent Number: 5,161,269

[45] Date of Patent: Nov. 10, 1992

[54] CRIB COVER

[76] Inventors: Susan H. McLean; James W. McLean, both of 20636 Hartsbourne Way, Germantown, Md. 20874

[21] Appl. No.: 688,302

[22] Filed: Apr. 22, 1991

[51] Int. Cl.[5] ..... A47C 29/00

[52] U.S. Cl. ..... 5/414; 5/93.1

[58] Field of Search ..... 5/100, 93.1, 424, 414, 5/416, 508

[56] References Cited

U.S. PATENT DOCUMENTS

| | | | |
|---|---|---|---|
| 799,390 | 9/1905 | Kuykendall | 5/93.1 |
| 2,682,061 | 6/1954 | McConnell | 5/100 |
| 2,883,678 | 4/1959 | Heffernan | 5/93.1 |
| 2,927,331 | 3/1960 | Ruiz | 5/414 |
| 3,428,971 | 2/1969 | Finley | 5/100 |
| 4,015,297 | 4/1977 | Christian | 5/93.1 |
| 4,631,765 | 12/1986 | Casey | 5/420 |
| 4,694,516 | 9/1987 | Overman | 5/93.1 |
| 4,862,534 | 9/1989 | Gomez-Marcial | 5/414 |
| 4,945,584 | 8/1990 | LaMantia | 5/414 |
| 5,007,674 | 4/1991 | Franc | 5/414 |

*Primary Examiner*—Renee S. Luebke
*Assistant Examiner*—F. Saether
*Attorney, Agent, or Firm*—Robert E. Bushnell

[57] ABSTRACT

A cover of screen or mesh for preventing domestic animals, such as cats, from entering a crib. The cover can be utilized while a child is in the crib, if the child is not able to pull itself up to a standing position, to prevent an animal from joining the child in the crib and can be utilized when the crib is unoccupied to prevent an animal from entering the crib and spreading fur, dirt or otherwise disturbing the crib. The cover is designed to prevent entry, and does not restrain the child within the crib. The device utilizes interengaging hook-and-loop type securing strips, such as VELCRO, to secure the cover to place on the crib, and is designed to support the weight of the animals to be excluded so that the cover will not collapse into the crib. The cover incorporates an opening for passage of a crib accessory, such as a mobile, which remains in place during entry and exit of the child and during removal or replacement of the cover.

13 Claims, 3 Drawing Sheets

CRIB COVER

BACKGROUND OF THE INVENTION

The present invention relates to covers for cribs. More specifically, the present invention relates to covers for use while the crib is occupied or unoccupied to prevent unwanted entry into the crib.

Crib covers for retaining an infant within a crib or for preventing unwanted entry into a crib, such as those taught in Gomez-Marcial U.S. Pat. No. 4,862,534; Christian U.S. Pat. No. 4,015,297; Cleary U.S. Pat. No. 3,546,721 and Zindell U.S. Pat. No. 3,145,396, are found in a variety of configurations which provide varying degrees of effectiveness in securing a crib.

Although covers can be used when the crib is occupied, the infant in the crib must not be able to pull himself to a standing position. Once a child has become able to stand in the crib, the cover can only be used when the infant is not in the crib.

The above inventions teach crib covers of screen or fabric for attachment to a standard crib. With the exception of Christian, these covers are not designed for easy removal, but instead provide openings for removal of the child through the screen.

None of these patents address the problem of preventing domestic animals from entering the crib and therefore fail to be adequately constructed for effective exclusion of domestic animals. Gomez-Marcial is concerned with screening out insects, while the remainder are directed to retaining a child within the crib.

Goldman U.S. Pat. No. 2,881,778 also teaches a screen covering for a crib or playpen. Goldman is simply draped over the crib and would not support any weight without collapsing.

Abajian U.S. Pat. No. 3,165,760, which teaches a crib made of tubes and screen, while referring to protection from animals, is a complex self contained device which does not lend itself to attachement to a standard crib.

A number of additional devices are taught in the art, as exemplified by the patents to Ruiz U.S. Pat. No. 2,927,331; Heffernan U.S. Pat. No. 2,883,678; Scott U.S. Pat. No. 2,781,523; Potter U.S. Pat. No. 2,699,794; Mover U.S. Pat. No. 2,586,247 and Ball U.S. Pat. No. 2,571,406. These devices are cumbersome and complex, and the structures taught are not readily adaptable to currently standard cribs.

SUMMARY OF THE INVENTION

It is an object of the present invention to provide a crib cover which provides easy access to an infant while providing sufficient strength to support the weight of a domestic animal in order to prevent unwanted entry.

It is another object of the present invention to provide a crib cover which provides easy removability while excluding domestic animals.

It is a further object of the present invention to provide an easily removable cover utilizing velcro straps and designed for preventing animals from entering the crib while providing a safe environment for a child occupying the crib.

It is yet another object of the invention to provide a device which is easily fitted to a variety of standard crib designs.

It is a further object of the invention to provide a device which allows for attachment of crib accessories, such as mobiles and allows for removal and replacement of the cover without disturbing the accessory.

It is a further object of the present invention to provide a device having a configuration adapted to secure to a variety of crib configurations while providing a sufficiently secure structure to exclude unwanted entry.

The crib cover taught in the exemplary embodiment described herein satisfies these and other objects with a design allowing for secure attachment with hook-and-loop strips which also provide easy removal for access to an infant. The device also incorporates securing strips, extending along a substantial portion of the circumference of the cover to provide for secure attachment.

The cover of the present invention can be installed easily and quickly to allow for replacement of the device after removal of the infant from the crib so that the crib can be secured against unwanted entry while the infant is out of the crib.

BRIEF DESCRIPTION OF THE DRAWINGS

For a better understanding of the nature of the present invention, reference is had to the following figures and detailed description, wherein like elements are accorded like reference numerals, and wherein.

DETAILED DESCRIPTION OF PREFERRED EXEMPLARY EMBODIMENTS

Figure 2:
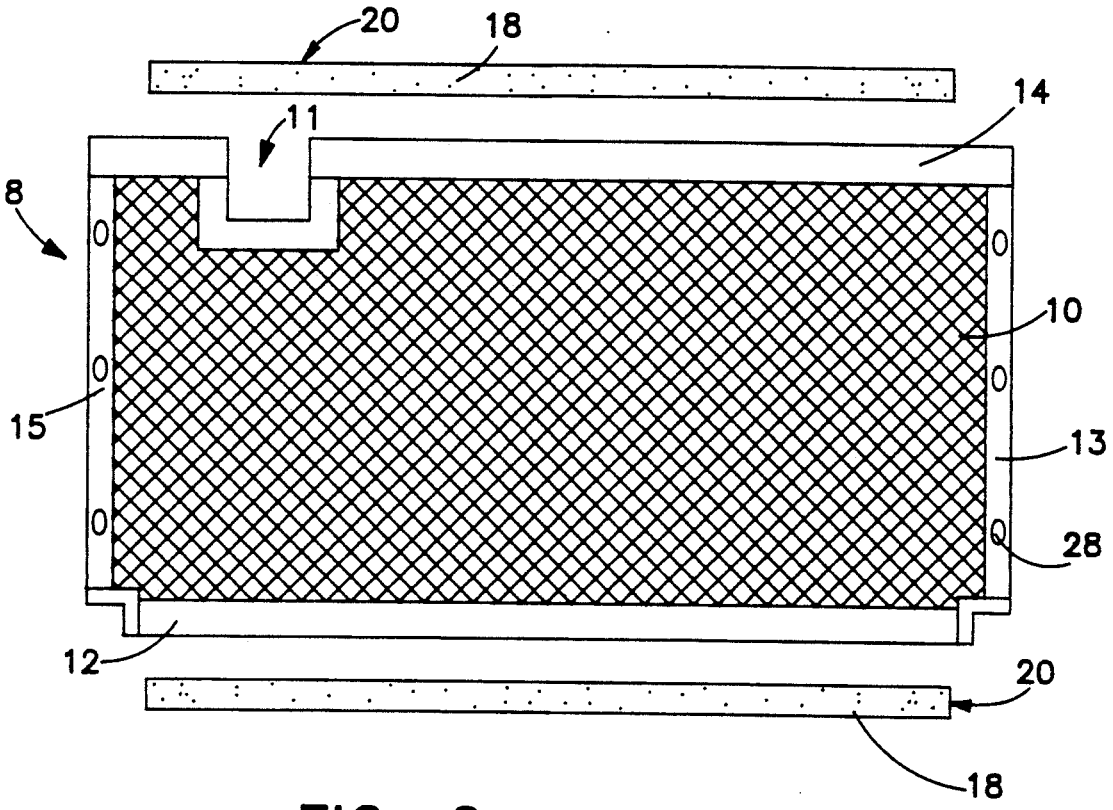
FIG. 2 is a top view of the cover and securing strips of the present invention removed and laying flat.
Figure 3:
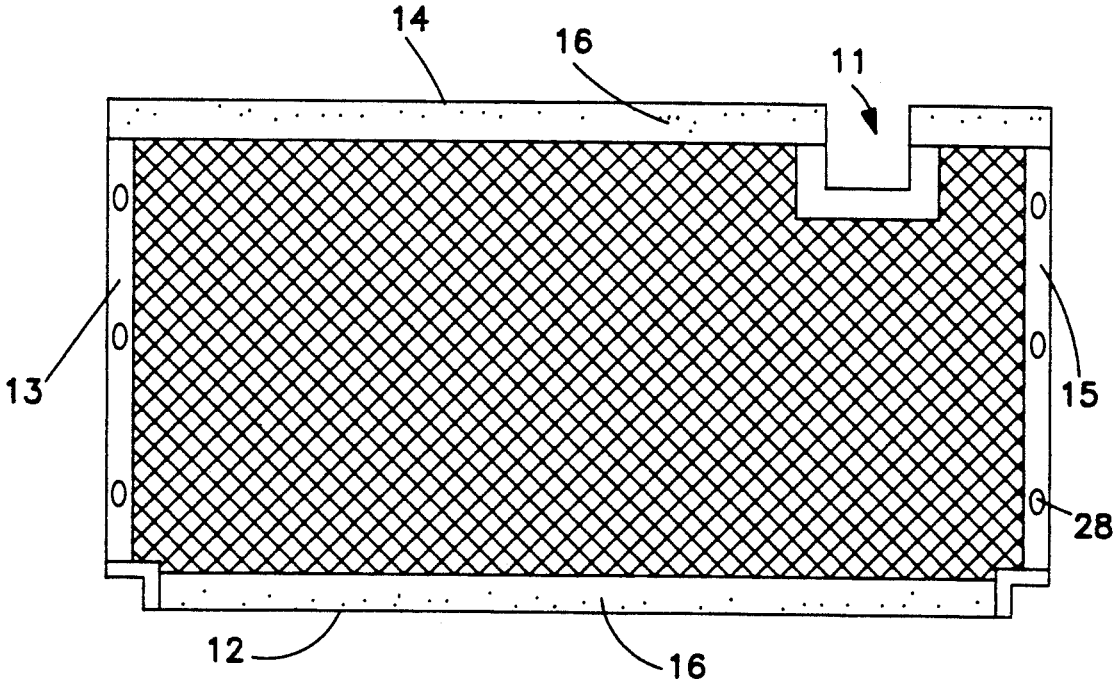
FIG. 3 is a bottom view of the cover of the present invention removed and laying flat.

As illustrated in FIGS. 2 and 3, the cover 8 is essentially rectangular, corresponding to the upper opening of a crib. A central screen portion 10 allows airflow through the cover and provides a surface for support for animals which may climb on top of the cover 8. A notch 11 is provided along one edge of the cover to allow for attachment of crib accessories such as a mobile.

The provision of the notch 11 allows for removal and replacement of the cover and allows for entry and exit by the infant without disturbing the crib accessory. The accessory can be viewed by the infant through the screen 10 while the cover 8 is in place.

The screen 10 is provided with an edging constructed of a strong material, such as nylon cloth, which provides sufficient support strength and shape to the cover to support the screen and maintain the rectangular configuration. The edging extends about the circumference of the screen 10 along the front 12 and rear 14 as well as the ends 13 and 15.

Figure 1:
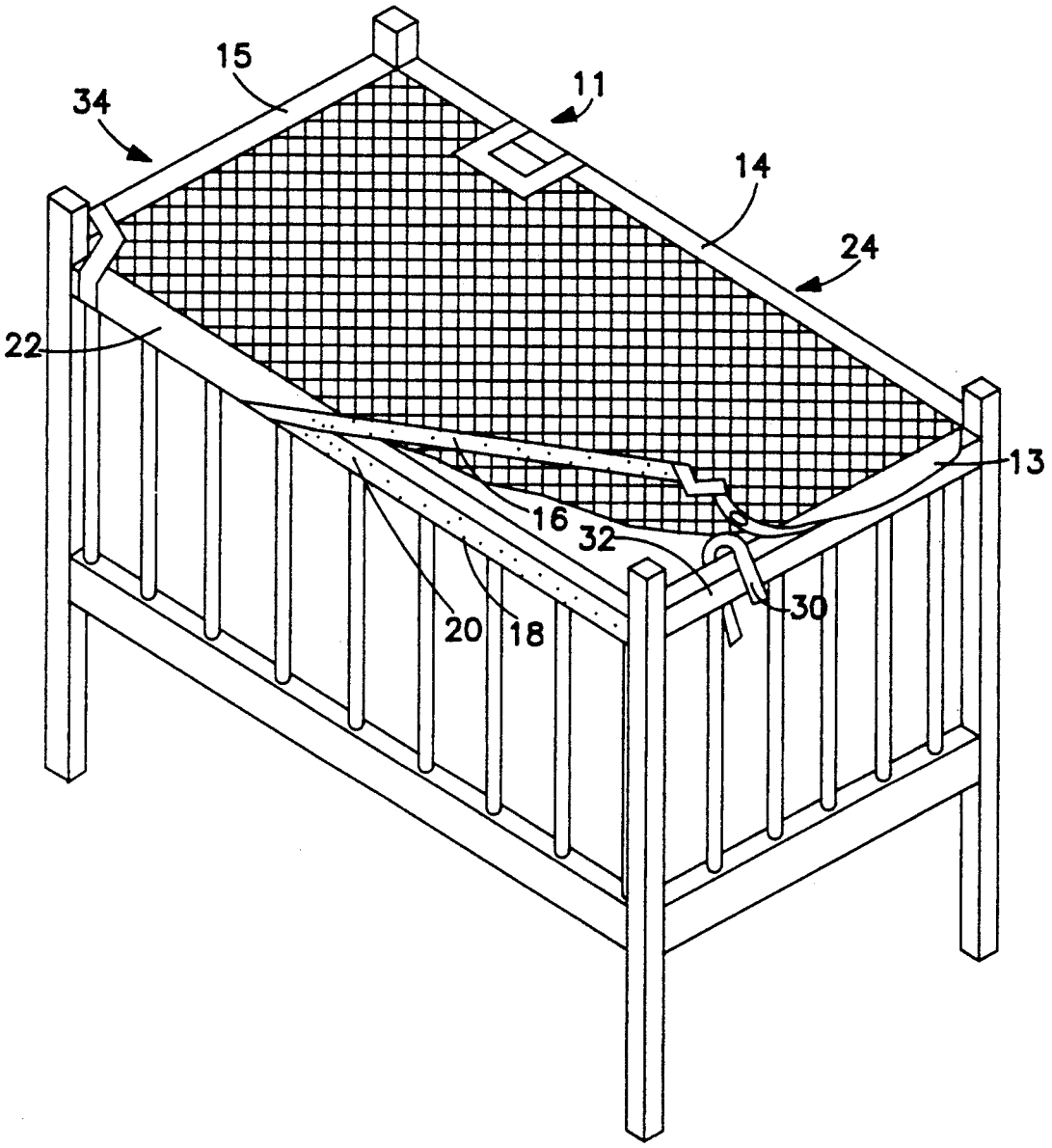
FIG. 1 is a perspective view of the present invention attached to a crib with one corner of the cover partially open.

Securing strips 20 are also provided and are attached to the front and rear rails 22 and 24 of the crib, as illustrated in FIG. 1, to provide a surface for the repeated securing of the cover. The strips 20 can be provided with an adhesive backing for semi-permanent attachment to the side rails 22 and 24. Alternatively the strips 20 can be attached with glue, staples or by other means.

The front 12 and rear 14 edging are provided with one component 16 of a hook-and-loop interengaging fastener, such as VELCRO, as illustrated in FIG. 3. Securing strips 20 are provided with a complementary hook-and-loops component 18 on one surface for engagement with component 16. The use of VELCRO or similar multiple engagement/disengagement type securing means allows for repeated removal and replacement of the cover. The surface area of contact of the complementary VELCRO portions must be sufficient to provide a secure attachment for supporting the weight of a domestic animal.

The side edging 26 along the ends of the cover can be provided with one or more openings or slots 28 for receipt of straps 30 for further securing the ends of the cover to the crib.

As illustrated in FIG. 1, the strips 20 are semi-permanently attached to the side rails 32 and 34 of the crib. The cover can then be quickly and repeatedly secured to and removed from the crib through interengagement of the engaging component 16 with the complementary component 18. Straps 30 can be added to further retain the ends of the cover to the crib ends.

The cover, when properly secured, prevents unwanted entry into the crib. The cover supports a substantial weight thereby preventing collapse under the weight of domestic animals. The cover also acts as a resting surface for domestic animals, thereby lessening their desire to enter the crib. Because the edges of the cover are secured to the crib rails, domestic animals are prevented from slipping under the edge of the cover.

When it is desired to remove a child from the crib, the cover need not be completely removed. One corner of the cover, as illustrated in FIG. 1, can be opened to provide for assess to the crib interior.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

We claim:

1. A crib cover, comprising:

an enclosure body formed partially of an open mesh product maintaining in a rectangular configuration and proportioned to cover upper rail panels of a crib, said enclosure body having a perimeter and secure means extending along a substantial portion of said perimeter for securing said enclosure body onto upper front, end, and side rail panels of said crib, said secure means having a pair of elongated securing strips attached at side edges with respect to said enclosure body and extending substantially an entire length thereof, and a plurality of apertures through front and end edges of said enclosure body;

a plurality of straps for securing said enclosure body onto said front and end rail panels of said crib using said plurality of apertures at said front and end edges; and a pair of elongated gripping means, each attached to a surface area extending along substantially an entire length of said side rail panels of said crib, for receiving each of said pair of elongated securing strip means, wherein said elongated securing strip means being provided with interengaging fastener components, and said elongated gripping means being provided with complementary interengaging fastener components.

2. The crib cover as claimed in claim 1, wherein said surface area of said side rail panel is selected to provide sufficient protection for supporting the weight of a domestic animal.

3. The crib cover as claimed in claim 1, wherein each of said elongate securing strips and said elongated gripping strip means are fabricated of VELCRO material.

4. The crib cover as claimed in claim 1, wherein said enclosure body has at least one notch opening accessible for replacing or removing a cover.

5. A crib cover, comprising:

an enclosure body formed partially of an open mesh product and proportioned to cover upper rail panels of a crib, said enclosure body having a perimeter and secure means extending along a substantial portion of said perimeter for securing said enclosure body onto upper front, end, and side rail panels of said crib, said secure means having a pair of elongated securing strips extending along substantially an entire length of said body with a notch portion attached at a side edge with respect to said enclosure body, and a plurality of apertures through front and end edges of said enclosure body;

a plurality of straps for securing said plurality of apertures at said front and end edges of said enclosure body onto said front and end rail panels of said crib; and a pair of elongated gripping means, each attached to a surface area extending along substantially an entire length of said side rail panels of said crib, for receiving each of said pair of elongated securing strips, wherein said elongated securing strip means being provided with interengaging fastener components, and said elongated gripping means is provided with complementary interengaging fastener components.

6. The crib cover as claimed in claim 5, wherein said surface area of said side rail panel is selected to provide sufficient protection for supporting the weight of domestic animal.

7. The crib cover as claimed in claim 6, wherein said elongate securing strip means and said elongated gripping strips are fabricated by VELCRO material.

8. A crib cover for a crib having a plurality of pairs of oppositely disposed and spaced-apart rails with a first pair and a second pair interposed between said first pair of said plurality of pairs of said oppositely disposed and spaced-apart rails, comprising:

a flexible body formed partially of a flexible open mesh product having a central portion bounded by a perimeter and substantially proportioned to enclose a crib, said flexible body having a plurality of pairs of oppositely disposed and spaced-apart secure means extending along a substantial portion of said perimeter of said flexible body for securing said flexible body onto said plurality of pairs of oppositely opposed and spaced-apart rails of said crib, said plurality of pairs of oppositely opposed and spaced-apart secure means comprising a first pair of secure means, having a plurality of apertures, through said flexible body, each aperture being provided with a complementary strap for strapping said first pair of secure means onto each rail of said first pair of rails from said plurality of pairs of oppositely opposed and spaced-apart rails of said crib, and a second pair of secure means, each of said second pair interposed between said first pair of secure means, having an elongated securing strip provided with an interengaging fastener component extending along substantially an entire length of said body;

a pair of elongated gripping strips, each elongated gripping strip being provided with an complementary interengaging fastener component and semi-permanently disposed substantially along an entire length of a surface area of each rail of said second pair of rails from said plurality of pairs of oppositely opposed and space-apart rails of said crib, for complementary engaging and disengaging said elongated securing strip of said first pair of secure means in a single manual motion, and whereby for each disengagement, said plurality of apertures of said first pair of secure means being loosely movable along said first pair of rails from said plurality of pairs of oppositely disposed and spaced-apart rails, thereby permitting said flexible body to freely separate from said plurality of pairs of oppositely opposed and spaced-apart rail of said crib.

9. The crib cover as claimed in claim 8, wherein said surface area of each rail of a second interposed pair of rails from said plurality of pairs of oppositely opposed and space-apart rails of said crib is selected to provide sufficient protection for supporting the weight of a domestic animal.

10. The crib cover as claimed in claim 8, wherein each of said elongated securing strips and each of said elongated gripping strips are fabricated of VELCRO material.

11. The crib cover as claimed in claim 8, wherein said notch portion exposes a partial length of an adjacent one of said upper rail panels.

12. The crib cover as claimed in claim 8, wherein each of said elongated securing strips and each of said elongated gripping strips are a continuous strip.

13. The crib cover as claimed in claim 8, wherein one of said elongated securing strips comprises a plurality of discontinuous strips.

* * * * *